US011512498B2

(12) United States Patent
Haagendrup

(10) Patent No.: US 11,512,498 B2
(45) Date of Patent: Nov. 29, 2022

(54) LATCH ASSEMBLY

(71) Applicant: CLM NORDIC AB, Stockholm (SE)

(72) Inventor: Charlie Pigonska Haagendrup, Stockholm (SE)

(73) Assignee: ZIPPLIFY AB, Stockholm (SE)

( * ) Notice: Subject to any disclaimer, the term of this patent is extended or adjusted under 35 U.S.C. 154(b) by 238 days.

(21) Appl. No.: 16/882,592

(22) Filed: May 25, 2020

(65) Prior Publication Data

US 2021/0348421 A1 Nov. 11, 2021

(30) Foreign Application Priority Data

May 8, 2020 (EP) ..... 20173691

(51) Int. Cl.
*E05B 47/00* (2006.01)
*E05B 15/00* (2006.01)
*E05B 55/12* (2006.01)

(52) U.S. Cl.
CPC ..... *E05B 47/0002* (2013.01); *E05B 15/0053* (2013.01); *E05B 47/0012* (2013.01); *E05B 55/12* (2013.01); *E05Y 2201/42* (2013.01); *E05Y 2201/462* (2013.01); *E05Y 2600/31* (2013.01); *E05Y 2900/132* (2013.01)

(58) Field of Classification Search
CPC ..... E05B 47/0002; E05B 15/0053; E05B 47/0012; E05B 55/12; E05Y 2201/42; E05Y 2201/462; E05Y 2600/31; E05Y 2900/132
See application file for complete search history.

(56) References Cited

U.S. PATENT DOCUMENTS 3,733,861 A 5/1973 Lester
5,943,888 A * 8/1999 Lawson ..... E05B 63/248 292/341.15
6,462,431 B1 * 10/2002 Woo ..... G07C 9/00182 307/142
6,477,872 B1 * 11/2002 Denton, Jr. ..... E05B 67/36 70/80

(Continued)

FOREIGN PATENT DOCUMENTS

| | | |
|---|---|---|
| EP | 0557861 | 9/1993 |
| GB | 2212847 | 8/1989 |
| WO | 03062571 | 7/2003 |

OTHER PUBLICATIONS

European Patent Office, European Search Report for corresponding EP Application No. 20173691.5, dated Nov. 3, 2020.

*Primary Examiner* — Mark A Williams
(74) *Attorney, Agent, or Firm* — Fasth Law Offices; Rolf Fasth

(57) ABSTRACT

A latch assembly comprising an elongated flat latch slider slidable along a first axis between a first position and a second position in relation to a main latch, wherein the latch slider is provided with a protruding lug; a lock arrangement comprising; a body moving between a locking position and an unlocking position, wherein in the locking position a portion of the body is preventing movement of the lug along a path in parallel with said first axis, and in the unlocking position the lug can be moved along said first axis; and an electrically powered device connected to the body for moving the body between the locking position and the unlocking position.

14 Claims, 6 Drawing Sheets

(56) References Cited

U.S. PATENT DOCUMENTS

| | | | | |
|---|---|---|---|---|
| 8,814,233 | B2 * | 8/2014 | Leska | F16P 3/10 292/144 |
| 10,267,059 | B1 * | 4/2019 | Schulz | E05B 15/029 |
| 10,400,472 | B2 * | 9/2019 | Schultz | E05B 65/0014 |
| 10,519,692 | B1 * | 12/2019 | Baird | E05B 15/10 |
| 10,612,275 | B2 * | 4/2020 | Lynn | A45C 11/008 |
| 10,724,277 | B2 * | 7/2020 | Baker | E05B 65/0007 |
| 10,941,552 | B2 * | 3/2021 | Grody | E03D 5/12 |
| 2003/0206104 | A1 | 11/2003 | Lowry et al. | |
| 2015/0115629 | A1 * | 4/2015 | Gartner | E05B 65/0082 292/220 |
| 2015/0233146 | A1 * | 8/2015 | Klevens | E05B 17/10 340/687 |
| 2020/0270903 | A1 * | 8/2020 | Stein | E05B 47/0607 |

* cited by examiner

LATCH ASSEMBLY

TECHNICAL FIELD

The present invention relates to a latch assembly.

Latch assemblies often are used for keeping different types of doors closed. A latch assembly comprises a latch and a latch slider that can be extended from the latch in a sliding movement. Normally, grip portion such as a knob or handle that protrudes perpendicularly from the latch slider through an aperture of the latch is used for manually sliding the slider between an open (unlocked) position and a closed (locked) position. Different types of locks can be applied to prevent the slider from moving from the closed position to the open position.

Presently used latch assemblies often are provided with mechanical locks requiring a conventional key that can get lost.

BACKGROUND

From the above it is understood that there is room for improvements and the invention aims to solve or at least mitigate the above and other problems.

SUMMARY

The invention is defined by the appended independent claims. Additional features and advantages of the concepts disclosed herein are set forth in the description which follows, and in part will be obvious from the description, or may be learned by practice of the described technologies. The features and advantages of the concepts may be realized and obtained by means of the instruments and combinations particularly pointed out in the appended claims. These and other features of the described technologies will become more fully apparent from the following description and appended claims, or may be learned by the practice of the disclosed concepts as set forth herein.

The disclosed latch assembly comprises a base plate or main latch and a flat latch slider that can slide in a sliding direction in relation to the latch between a laterally extended and a non-extended position relative to the base plate. In the extended position, a front section of the slider will be received in a corresponding aperture in a door frame and thus lock the door from being opened. The latch assembly comprises a lock arrangement interacting with a lock element protruding from the slider.

In various embodiments, the lock arrangement comprises a head rotating around an axis of rotation. The axis of rotation is offset from the geometric center of the head. The slider is provided with a protruding lug that will engage a section of the head in a locked position. By rotating the head to an unlocked position, the protruding lug of the slider can pass by the head and slide to a position where the front section of the slider no longer is received in the aperture in the door frame. In this position, the door can be opened.

In alternative embodiments, the lock arrangement comprises an axially displaceable pin. The slider is provided with a protruding lug with a locking aperture that will receive a section of the pin in a locked position. By retracting the pin to an unlocked position, the protruding lug of the slider can pass by the pin and slide to a position where the front section of the slider no longer is received in the aperture in the door frame. In this position, the door can be opened. The axially displaceable pin will move in a direction perpendicular to the sliding direction of the latch slider.

In various embodiments, the head is connected to an electric motor, such as a DC. A power supply unit, such as a set of batteries provides electric power to the electric motor.

In various embodiments, the latch assembly comprises a lock control unit and a communications unit. The control unit controls the electric motor and other electric and electronic components on the basis of information received through the communications unit, and of a set of control steps stored in a memory unit. In various embodiments, the control unit, the communications unit and the memory unit are combined in one chip. The communications unit can comprise several different communication elements, such as circuits for Bluetooth communication, WIFI communication and GSM, 4G or 5G cellular systems. In various embodiments, the communications unit comprise also an element for Near Field Communication (NFC). Some of these elements can be implemented as separate chips. Locking and unlocking of the latch assembly is made from a remote control unit, such as a mobile telephone or smartphone. The remote control unit will establish a communication link to the lock control unit and a user may request unlocking of the latch assembly by a command on the remote control unit. If the request is granted by the lock control unit the latch assembly will be unlocked. Using NFC in the latch assembly as well as in the remote control unit will ensure that communication can be initiated only if the units are very close to each other.

In a first aspect the disclosed latch assembly comprises an elongated flat latch slider slidable along a first axis between a first position and a second position in relation to a main latch, wherein the latch slider is provided with a protruding lug; a lock arrangement comprising; a body moving between a locking position and an unlocking position, wherein in the locking position a portion of the body is preventing movement of the lug along a path in parallel with said first axis, and in the unlocking position the lug can be moved along said first axis; and an electrically powered device connected to the body for moving the body between the locking position and the unlocking position.

BRIEF DESCRIPTION OF THE DRAWINGS

In order to best describe the manner in which the above-described embodiments are implemented, as well as define other advantages and features of the disclosure, a more particular description is provided below and is illustrated in the appended drawings. Understanding that these drawings depict only exemplary embodiments of the invention and are not therefore to be considered to be limiting in scope, the examples will be described and explained with additional specificity and detail through the use of the accompanying drawings in which.

Further, in the figures like reference characters designate like or corresponding parts throughout the several figures.

DETAILED DESCRIPTION

Various embodiments of the disclosed methods and arrangements are discussed in detail below. While specific implementations are discussed, it should be understood that this is done for illustration purposes only. A person skilled in the relevant art will recognize that other components, configurations, and steps may be used without parting from the spirit and scope of the disclosure.

In the description and claims the word "comprise" and variations of the word, such as "comprising" and "comprises", does not exclude other elements or steps.

Hereinafter, certain embodiments will be described more fully with reference to the accompanying drawings. It will be apparent to those skilled in the art that various modifications and variations can be made without departing from the inventive concept. Other embodiments will be apparent to those skilled in the art from consideration of the specification and practice disclosed herein. The embodiments herein are provided by way of example so that this disclosure will be thorough and complete, and will fully convey the scope of the inventive concept, and that the claims be construed as encompassing all equivalents of the present inventive concept which are apparent to those skilled in the art to which the inventive concept pertains. If nothing else is stated, different embodiments may be combined with each other.

Figure 1:
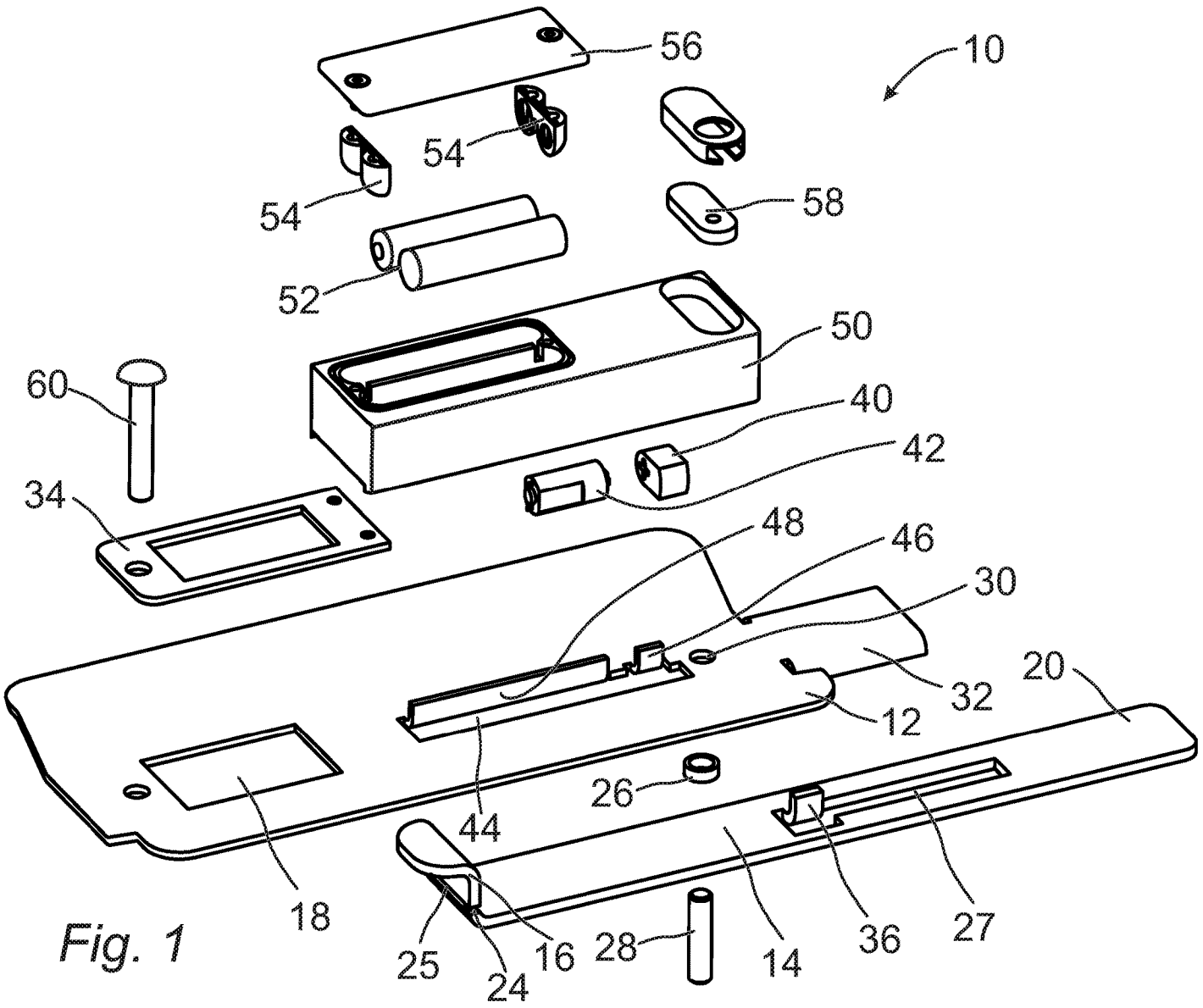
FIG. 1 is a schematic exploded view showing a disclosed latch assembly.

In the embodiment of a disclosed latch assembly 10 shown in FIG. 1, all components and elements are shown in an exploded view. In all other figures, different embodiments of the latch assembly 10 are assembled to a working state. A base plate 12 or main latch supports other parts of the latch assembly 10 and will be attached to a door (not shown) when in use. A flat elongated latch slider 14 is provided with a grip portion 16 at one end and a slider extension 20 at an opposite end. In use, the latch slider 14 is mounted on a back side of the main latch 12 between the door and the main latch 12, and the grip portion 16 will extend through a grip aperture 18 in the main latch 12. In this position, the latch slider 14 can slide between a first extended position in which the slider extension 20 is received in an aperture in a door frame or corresponding element, and a second retracted position in which the slider extension 20 is not received in the slider extension. The latch slider 14 will slide with a flat upper side moving along a flat bottom side of the main latch. Normally, the door can be opened in the second position. The grip portion 16 extends perpendicularly or substantially perpendicularly from the flat upper side of the latch slider 14.

The latch slider 14 is guided on two grooves 24 provided at a lower section of the grip portion 16, and a spacer ring 26 on a bolt 28. The bolt 28 extends through a hole 30 in the main latch 12 and an elongated aperture 27 in the latch slider 14. The grooves 24 will slide on a slide support 34 attached to the main latch 12 over the grip aperture 18. An elongated weakening aperture 25 extends in the grip portion 16 between the grooves 24. If the grip portion 16 is exerted to high forces, such as during an attempt to break the latch assembly 10, the grip portion 16 will break along the elongated weakening aperture 25. As a result, further attempts to force the latch slider to an open position will be made more difficult. During movement of the latch slider 14, the spacer ring 26 is received in the elongated aperture 27 in the latch slider 14. In the retracted position, the slider extension 20 is at least substantially covered by a latch extension 32, cf. FIG. 2 and FIG. 3. The latch slider 14 is provided with a protruding element, such as a lug. In the embodiment shown in FIG. 1, the protruding element is a flange 36 extending perpendicularly from the flat upper side of the latch slider 14. In various embodiments, the protruding element is a ridge welded to the latch slider 14.

The main latch 12 supports a lock arrangement with a moving lock key or head 40 that interacts with the flange 36 to either prevent the latch slide 14 from sliding from the extended position or to allow such a movement to unlock the latch assembly. In various embodiments, the head 40 is connected to an electric device such as a motor 42 through a drive shaft. When the motor 42 is activated, the shaft will rotate the head 40 around an axis of rotation. The axis of rotation of the head 40 is displaced from the geometric center of the head, cf. FIG. 4 and FIG. 5. As a result, the head 40 will rotate between a locking position where an engaging section of the head 40 will engage the flange 36 to prevent sliding of the latch slider 14, and an unlocking position where rotation of the head 40 has displaced the engaging section, so as to allow the flange 36 to pass by the head 40.

The main latch 12 is provided with a central elongated slot 44 in which the flange 36 slides when the latch slider 14 moves between the extended and the retracted positions. In the extended (locked) position the flange 36 faces a forward latch flange 46 extending from a side edge at a front section of the central elongated slot 44. A rear latch flange 48 extends from the same side edge of the central elongated slot 44 leaving a free space therebetween to receive the head 40 in the locking position, cf. FIG. 4.

A housing 50 is provided on the main latch 12 for a power source, such as batteries 52, for the motor 42 and for components of the lock arrangement. The housing 50 also supports an electronic lock unit 58 comprising a control unit, a communications unit and a tamper detection unit. The batteries 52 are electrically connected by two battery holders 54, and are placed in a battery compartment covered by a lid 56. The lid 56 can easily be removed from the outside of the door when the batteries need to be changed. A fastening bolt 60 is arranged to extend through a hole in the slide support 34 and the main latch 12, and is fastened in the door. The bolt 28 is screwed into a threaded hole in a bottom side of the housing and also fastened to the door.

Figure 2:
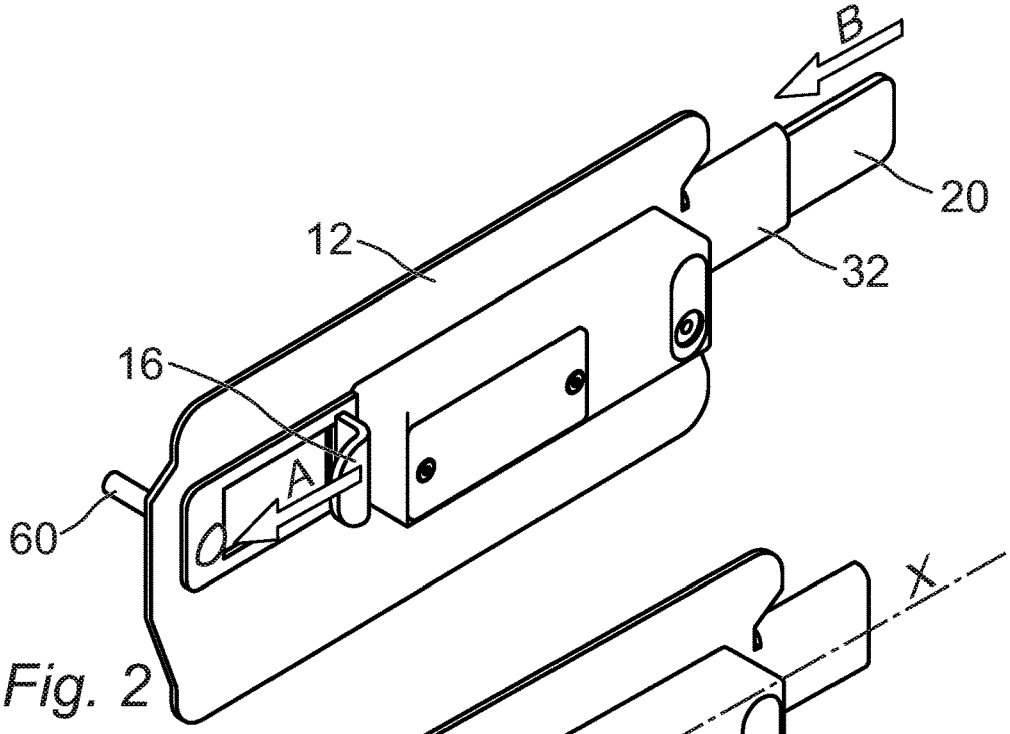
FIG. 2 is a schematic perspective view of the assembled latch assembly of FIG. 1 in a locked position.
Figure 3:
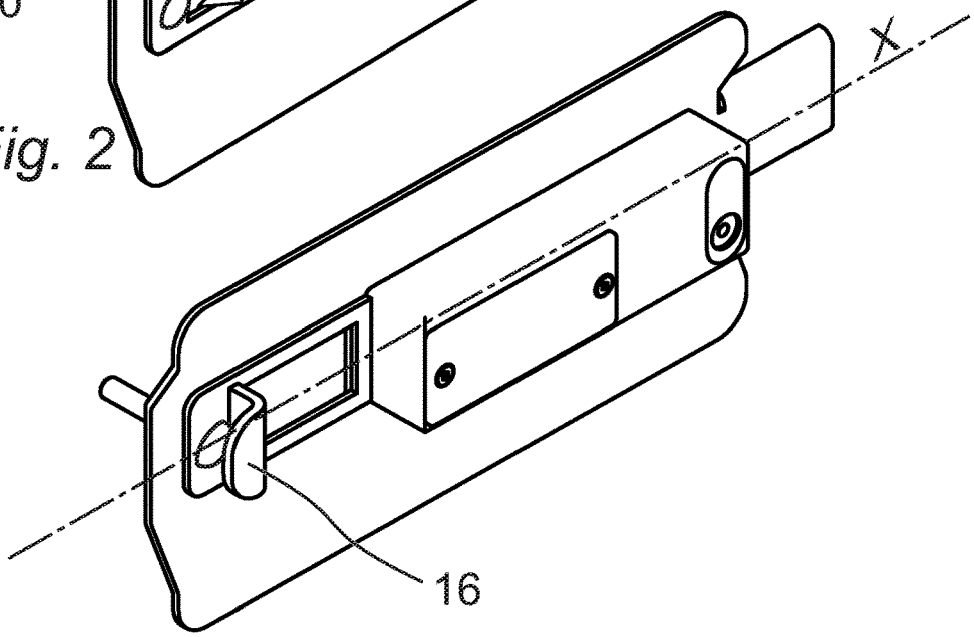
FIG. 3 is a schematic perspective view of the assembled latch assembly of FIG. 1 in an unlocked position.

The latch assembly 10 is shown in a locked position in FIG. 2, and in an unlocked position in FIG. 3. In the locked position, the slider extension 20 extends out from the latch extension 32. As long as the latch assembly 10 is in the locked position, it is not possible to slide the grip portion in the direction of arrow A. As a result, the slider extension 20 cannot slide in the direction of arrow B, that is to an unlocked position. After unlocking of the latch assembly 10, it is possible to slide the grip portion 16 in the direction of arrow A along axis X to an unlocked end position as shown in FIG. 3. In this position, the slider extension 20 is fully retracted and covered by the latch extension 32. In this position, the door can be opened.

Figure 5:
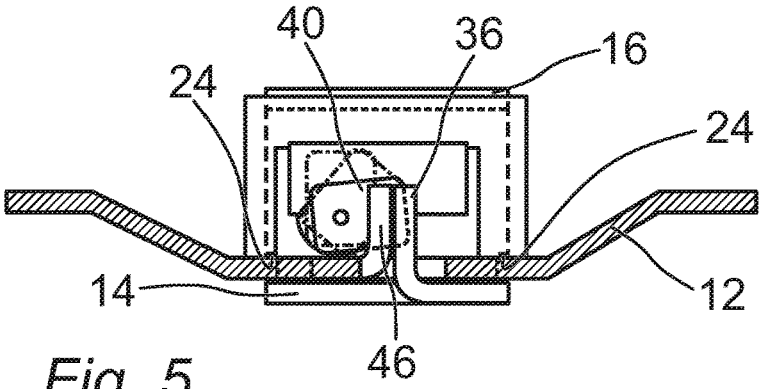
FIG. 5 is a schematic sectional view from line V-V of FIG. 4.
Figure 4:
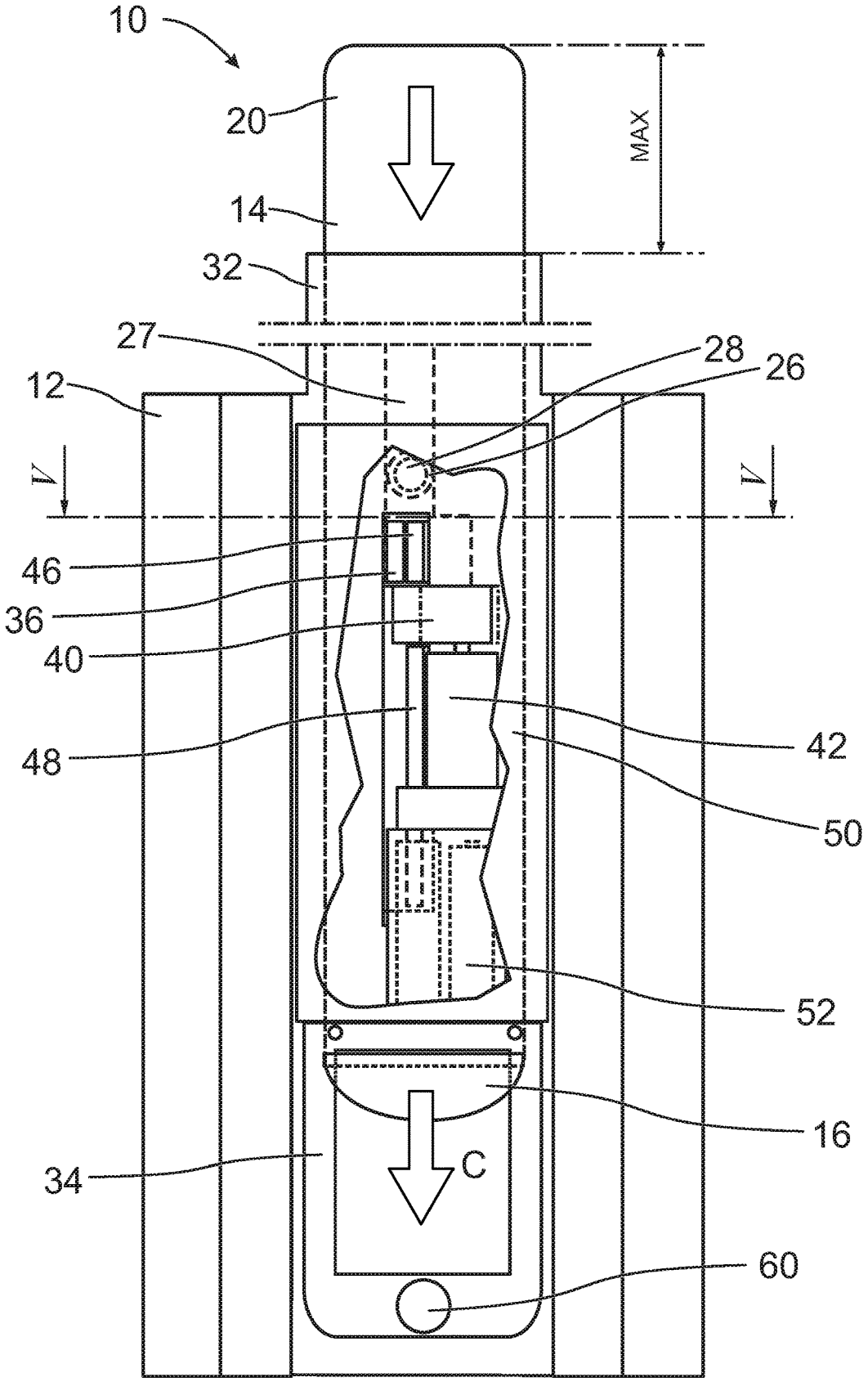
FIG. 4 is a schematic top view partly cut through of a latch assembly.

In the embodiment of a disclosed latch assembly 10 shown in FIG. 4 and FIG. 5, a latch slider 14 is extended to a maximum from the main latch 12. In this position, an end portion of the slider extension 20 is extended a maximum distance from an end portion of the latch extension 32 of the main latch 12, and the door on which the latch assembly 10 is attached is locked. The head 40 is rotated to a position where it is secured between the forward latch flange 46 and the rear latch flange 48. In this position, the head 40 will prevent any sliding movement of the slider flange 36 and thus of the latch slider 14 in the direction of arrow C, even if considerable force is exerted on the grip portion 16 or any other part of the latch slider 14. When unlocked, the head 40 will be rotated to a more upright position as indicated by dash-dotted lines allowing the slider flange 36 and thus the latch slider 14 to slide in the direction of arrow C.

During the sliding movement, the latch slider 14 is guided in the grooves 24 of the main latch 12. The head 40 is rotated by the motor 42 powered by the batteries 52. The motor 42 and the batteries 52 are mounted in the housing 50. The latch slider 14 is also guided by the spacer ring 26. The grooves 24 also form a weakened section that will be an indication of fracture if a tool such as a crowbar is put in between the grip portion 16 and the housing 50. Even if the grip portion 16 breaks it would still be possible to unlock the latch assembly 10 and then open the door.

Figure 6:
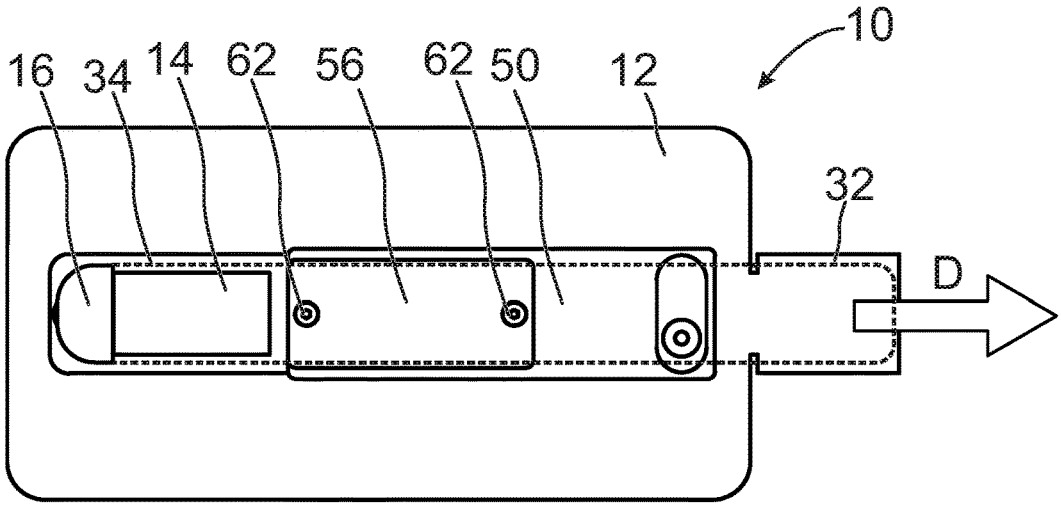
FIG. 6 is a schematic frontside view of the latch assembly in FIG. 3.
Figure 7:
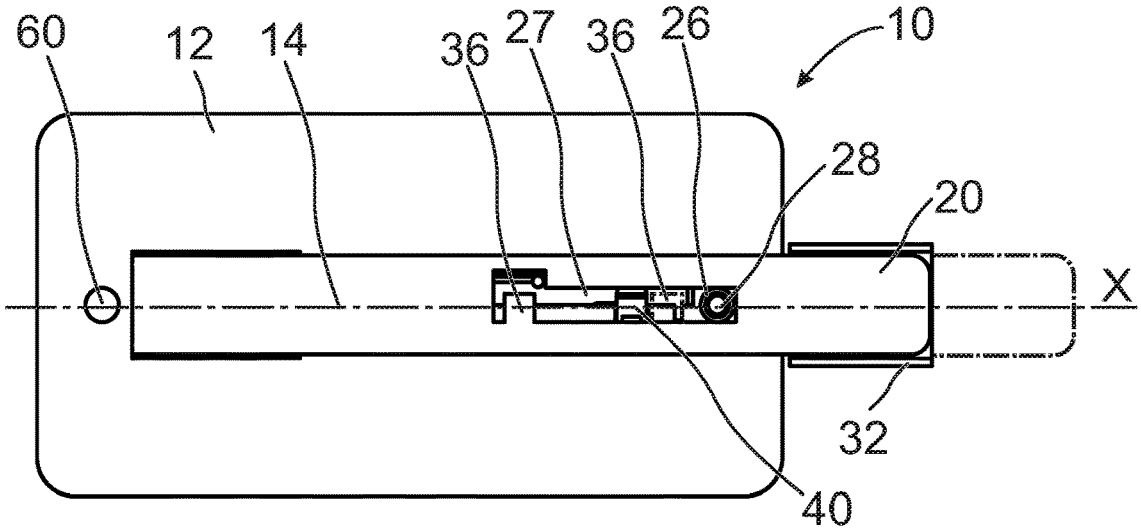
FIG. 7 is a schematic backside view of the latch assembly in FIG. 2.

FIG. 6 and FIG. 7 show the latch assembly 10 in a front view (as seen on a door) and in a back view, respectively. The grip portion 16 is shown pulled to an open position where the slider extension 20 is covered by the latch extension 32. The housing 50 safely protects the electronic lock unit, the motor 42 and the lock key or head 40. The batteries can be replaced by removing the lid 56 after unscrewing screws 62. The main latch 12 is attached to a door by the fastening bolt 60 and the bolt 28. The spacer ring 26 is received in the elongated aperture 27 when the latch slider 14 slides in the direction of arrow D from the open position to the locked position where the slider flange 36 has moved to an opposite side of the head 40, as shown by a dash-dotted line in FIG. 7.

Figure 8:
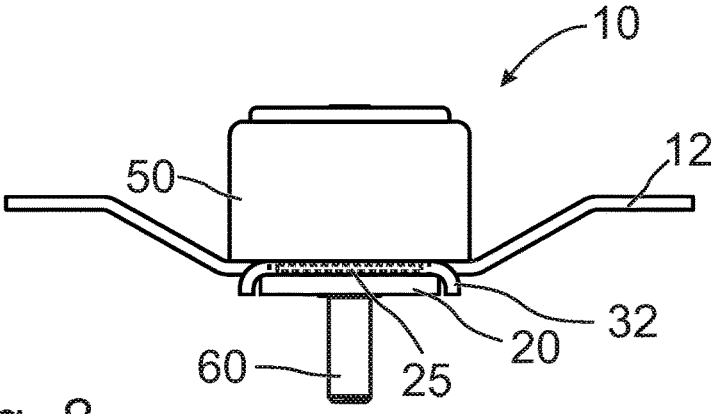
FIG. 8 is a schematic front view of assembled latch assembly of FIG. 1.

In FIG. 8, the latch assembly 10 is shown in a mounted configuration. The slider extension 20 is covered by the latch extension 32. The base plate or main latch 12 will engage the door (not shown). The housing 50 holds most of components of the latch assembly 10, and a top of the grip portion 16 extends over the housing 50. The elongated weakening aperture 25 is made at a lower section of the grip portion 16.

Figure 9:
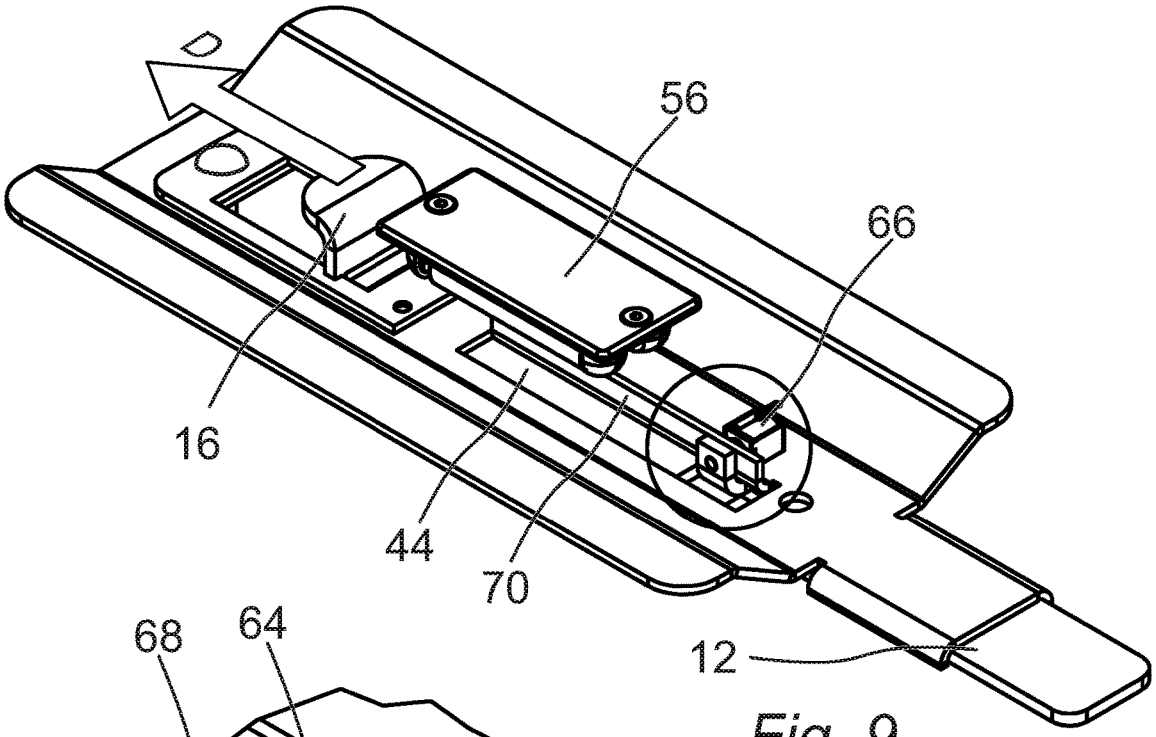
FIG. 9 is a schematic perspective view of an alternative embodiment of a latch assembly in a locked position.
Figure 10:
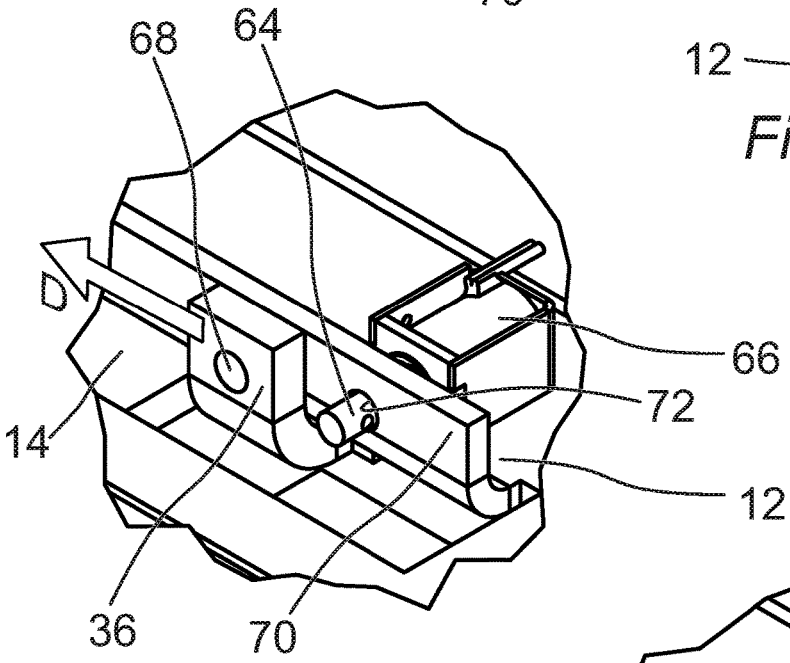
FIG. 10 is a schematic perspective view of a cut out part of the latch assembly in FIG. 9 in an unlocked position.
Figure 11:
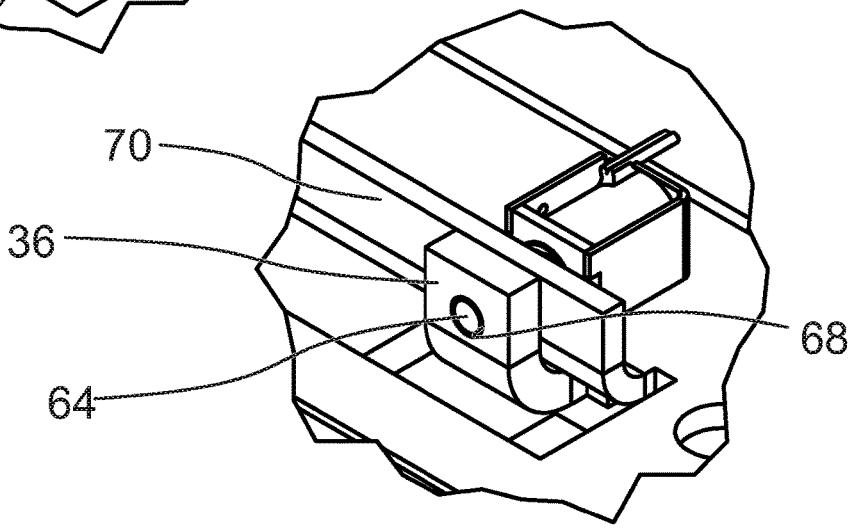
FIG. 11 is a schematic perspective view of a cut out part of the latch assembly in FIG. 9 in a locked position.

An alternative embodiment of the lock arrangement is shown in FIG. 9 to FIG. 11. In this alternative embodiment, the lock arrangement comprises an axially displaceable pin 64 that is moved by an electric device, such as a solenoid 66. The axially displaceable pin 64 interacts with the slider flange 36 to lock the latch slider 12 from axial displacement. In various embodiments, the slider flange 36 is provided with a locking aperture 68 arranged to receive the axially displaceable pin 64 in a locked position. The solenoid 66 and other electric and electronic components can be powered by a power source, such as batteries similar to the embodiments described above. In various embodiments, the axially displaceable pin 64 is spring biased to an extended position as shown in FIG. 10 and FIG. 11. Thus, the solenoid 66 needs to be activated to retract the axially displaceable pin 64 to allow the sliding movement of the slider flange 36 and the latch slider 14.

In FIG. 9 and FIG. 11, the latch slider 12 is positioned in a locked position and the axially displaceable pin 64 is received in the locking aperture 68 in the slider flange 36 to lock the latch slider 12 from axial movement. In this embodiment, the forward latch flange and the rear latch flange are joined to form a continuous guide flange 70. The guide flange 70 extends along the central elongated slot 44 of the main latch 12. The guide flange 70 is provided with a through hole 72 adjacent the solenoid 66. In the locked position, the through hole 72 and the locking aperture 68, are aligned to allow the axially displaceable pin 64 to extend through both of them. Thus, in the locked position, the axially displaceable pin 64 is very well protected against attempts to force the latch assembly 10.

In FIG. 10, the latch assembly 10 has been unlocked and the slider flange 36 has been moved in the direction of arrow D. This can be done by moving the grip portion 16 as indicated by arrow D in FIG. 9.

Figure 12:
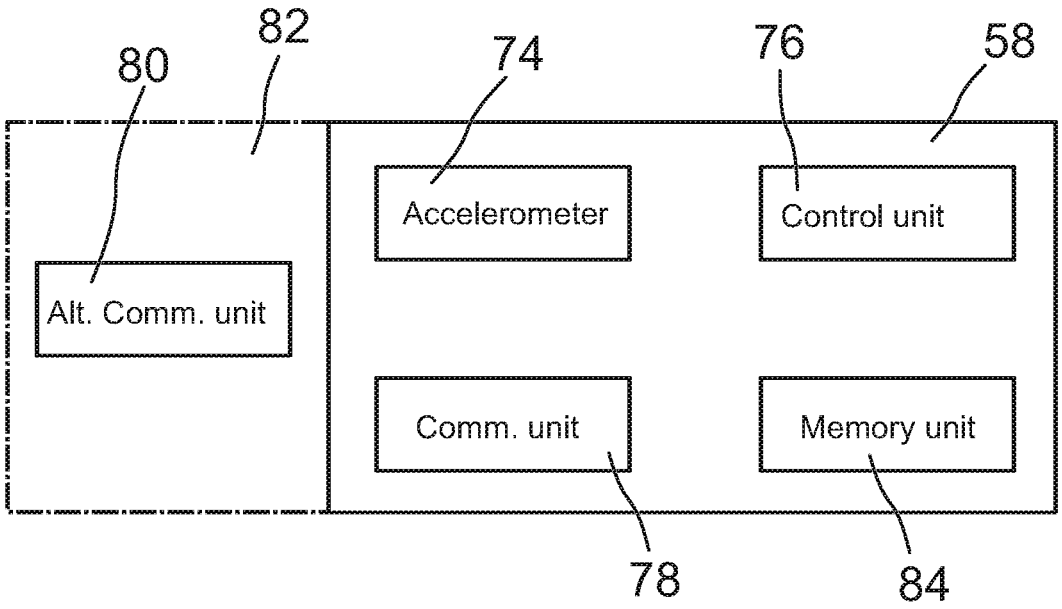
FIG. 12 is a schematic diagram showing main components of a lock unit for the disclosed latch assembly.

Any tamper attempts on the latch assembly 10 will be detected by the electronic lock unit 58 as shown in FIG. 12. In various embodiments, the electronic lock unit 58 comprises a tamper detection unit 74, such as an accelerometer detecting vibrations. The electronic lock unit 58 comprises also a control unit 76 that is arranged to analyze the vibrations. Specific characteristics of the vibrations associated to tamper attempts will trigger an alarm signal. The alarm signal can be transmitted to other devices for different measures to be taken, and can also be used to emit an alarm sound. The control unit 76 of the electronic lock unit 58 also generates control signals to the electric parts of the lock arrangement. In embodiments where an electric motor is used, different sets of control signals are used for rotating the head 40 toward the locked position and back. Feedback signals relating to present values of torque or the amount of current that is supplied to the motor are used by the control unit to determine when end positions of the rotating movement have been reached and the rotation movement has come to a stop. Normally, the control unit will then reverse the rotation direction to release the head from engaging other elements. The time periods normally needed for predetermined movements can be stored and used by the control unit. This function can also be used if any object obstructs movement of the head during locking and unlocking movements. If such an event happens outside the time periods, an alarm function can be triggered.

The electronic lock unit 58 also comprises at least one communications unit 78 with provisions for different wireless communication systems, such as NFC, Bluetooth, WiFi and GSM or other cellular mobile telephone systems. In various embodiments, some communication unit or units can be provided in separate chips or devices, such as an alternative communication unit 80 in a casing 82. The electronic lock unit 58 also comprises a memory unit 84 for storing different sets of software, such as firmware and application specific programs, and other data such as characteristics of the vibrations associated to tamper attempts and time periods normally needed for predetermined movements of the head 40 and the axially displaceable pin 64.

The various embodiments described above are provided by way of illustration only and should not be construed to limit the invention. For example, the principles herein may be applied to any remotely controlled device. Those skilled in the art will readily recognize various modifications and changes that may be made to the present invention without following the example embodiments and applications illustrated and described herein, and without departing from the scope of the present disclosure.

The invention claimed is:

1. A latch assembly comprising an elongated flat latch slider slidable along a first axis between a first position and a second position in relation to a main latch, wherein the latch slider is provided with a protruding lug;

a lock arrangement comprising:

a lock key being rotatable between a locking position and an unlocking position, wherein in the locking position a portion of the lock key engaging the lug and preventing movement of the lug along a path parallel with said first axis, and in the unlocking position the lug being movable long said first axis; and an electrically powered device connected to the lock key for moving the lock key between the locking position and the unlocking position;

wherein the latch slider at a first end is provided with a standing grip portion and at a second opposite end is provided with a slider extension, the standing grip portion has an elongated weakening aperture defined therein, wherein the standing grip portion will break along the elongated weakening aperture when exerted on by high forces.

2. The latch assembly of claim 1, wherein the lug of the latch slider extends through an elongated slot in the main latch, wherein a length of the elongated slot is sufficiently long to receive the lug when sliding the latch slider between the first position and the second position.

3. The latch assembly of claim 1, wherein the latch slider at a first end is provided with a standing grip portion and at a second opposite end is provided with a slider extension.

4. A latch assembly comprising an elongated flat latch slider slidable along a first axis between a first position and a second position in relation a main latch, wherein the latch slider is provided with a protruding lug;

a lock arrangement comprising:

a lock key moving between a locking position and an unlocking position wherein in the locking position a portion of the lock key preventing movement of the lug along a path in parallel with said first axis, and in the unlocking position the lug being movable along said first axis; and an electrically powered device connected to the lock key for moving the lock key between the locking position and the unlocking position;

wherein the latch slider at a first end is provided with a standing grip portion and at a second opposite end is provided with a slider extension, the standing grip portion has an elongated weakening aperture defined therein, wherein the standing grip portion will break along the elongated weakening aperture when exerted on by high forces.

5. The latch assembly of claim 2, wherein the main latch is provided with a protruding element adjacent to and extending along the elongated slot and facing the protruding lug at least in the first position of the latch slider.

6. The latch assembly of claim 1, wherein the electrically powered device comprises an electric motor connected to the body for rotating the body between a first locked position where at least a section of the rotating body is positioned in the path for preventing movement of the latch slider along the path, and a second unlocked position where no section of the rotating body is placed in the path.

7. The latch assembly of claim 5, wherein the protruding element of the main latch is provided with an opening sufficient wide to receive a section of the rotating body in the locked position.

8. The latch assembly of claim 5, wherein the protruding element of the main latch has a length substantially corresponding to the length of the elongated slot.

9. The latch assembly of claim 1, wherein the electrically powered device comprises an electromagnetic unit connected to the body for extending and retracting the body in a direction perpendicular to the first axis, and wherein the protruding lug is provided with a locking aperture for receiving the body in the locked position.

10. The latch assembly of claim 5, wherein the protruding element of the main latch has a length substantially corresponding to the length of the elongated slot.

11. The latch assembly of claim 1, wherein the latch slider has a flat upper side and the protruding lug is a bent section of the latch slider formed as a flange extending substantially perpendicular to the flat upper side.

12. The latch assembly of claim 5, wherein the protruding element of the main latch is a bent section of the main latch formed as a flange extending substantially perpendicular from the main latch.

13. The latch assembly of claim 1, wherein a spacer ring mounted on a bolt is received in an elongated aperture in the latch slider to stabilize the sliding movement of the latch slider.

14. The latch assembly of claim 1, wherein the main latch has a rear latch flange and a forward latch flange, the rear and forward latch flanges having a free space defined therebetween for receiving the lock key.

* * * * *